United States Patent [19]

Salvatore

[11] 4,012,066

[45] Mar. 15, 1977

[54] LOCK ASSEMBLY FOR AUTOMATICALLY DEAD BOLTING A CLOSURE

[75] Inventor: Ronald M. Salvatore, Stamford, Conn.

[73] Assignee: Accurate Lock and Hardware Co., Stamford, Conn.

[22] Filed: Oct. 28, 1975

[21] Appl. No.: 626,343

[52] U.S. Cl. ..... 292/341.13; 49/7; 292/38; 292/DIG. 66

[51] Int. Cl.[2] ..... E05B 15/02

[58] Field of Search ..... 292/DIG. 66, 38, 84, 292/169.14, 141, 83, 341.13; 160/1, 5; 49/1, 4, 7, 31

[56] References Cited

UNITED STATES PATENTS

| | | | |
|---|---|---|---|
| 144,288 | 11/1873 | Rand | 292/38 |
| 809,628 | 1/1906 | Pretsman | 292/38 |
| 2,238,266 | 4/1941 | Johnson | 292/38 X |
| 2,389,315 | 11/1945 | Kerr | 292/38 X |
| 2,812,835 | 11/1957 | Smiley | 49/7 |
| 3,811,717 | 5/1974 | Floyd | 292/DIG. 66 |

*Primary Examiner*—Ramon S. Britts
*Assistant Examiner*—Peter A. Aschenbrenner
*Attorney, Agent, or Firm*—St. Onge, Mayers, Steward & Reens

[57] ABSTRACT

A lock assembly for automatically dead bolting a closure to a closure frame when the ambient temperature is raised above a predetermined temperature by fire comprises a striker plate, which defines a bolt hole, mounted on the closure frame. A cooperating latching mechanism, installed in the closure, includes a housing and a bolt assembly mounted in housing for reciprocal movement to and from a latched position projecting into the striker plate bolt hole and for movement to an extreme dead bolted position projecting further into the bolt hole beyond the latched position. A stop pin mechanism associated with the bolt assembly prevents the bolt assembly from being moved out of the dead bolted position once this position is assumed and a spring urges the bolt toward the dead bolted position. The bolt assembly is reciprocated to and from its latched position and is ultimately moved to its dead bolted position by a bolt actuator mechanism which includes a crank, and a cable interconnecting the crank and the bolt assembly. A roller, which is disintegratable at the predetermined temperature, guides the cable through a first nonlinear path of active length sufficient only to permit the bolt assembly to assume its latched position. However, when the roller disintegrates at the predetermined temperature in a fire, the cable traverses a second path of active length sufficient to permit the bolt assembly to assume its dead bolted position.

15 Claims, 5 Drawing Figures

4
64
68
94
85
58
60
62
76
70
78
82
56
86
80
L1
26
46
74
47
72
24
40
54
12
34
50
52
28
48
32
36
30

66
85
94
60
68
58
82
76
78
80
46
56
24
86
70
47
72
74
40
54
44
34
38
50
42
12
52
48
28
36
32
30

84
85
64
68
64
60
62
58
76
82
78
56
86
24
$L_2$
26
46
70
74
72
38
40
54
50
38
52
14
28
48
30
32
36

LOCK ASSEMBLY FOR AUTOMATICALLY DEAD BOLTING A CLOSURE

BACKGROUND OF THE INVENTION

The present invention relates to a lock assembly for automatically dead bolting a closure to a closure frame when the ambient temperature is raised above a predetermined temperature by, for example, a fire. Assemblies of this type are known as fire safety locks and are most commonly used on fire safety doors.

In order to isolate a dangerous fire and resulting smoke, many modern buildings are divided into discreet, fire-tight compartments which are usually coextensive with a room or group of rooms. In order to maintain the integrity of each compartment, the doors which lead to and from it should be essentially fire proof and should be positively locked or "dead bolted" in a closed position to adequately contain a fire when one occurs. Moreover, since fire safety doors often provide access to rooms which are ordinarily in everyday use, the fire safety locks on them should function smoothly and easily in the absence of an emergency.

In the past, ensuring that fire safety doors stay closed and locked once a fire reaches certain proportions has been a major problem. Such doors usually warp severely under the intense heat, up to 1000° F, generated by some fires. Furthermore, sudden cooling which occurs when fire doors are sprayed with water from an automatic sprinkler system or from a fire fighter's hose, causes the door to warp even more. This warping causes extreme stress to be placed on the door lock which may consequently burst or be forced to unlatch or otherwise fail. Of course, if the lock fails, the fire safety door can open and can, thus, no longer contain or confine the fire.

Therefore, it is advantageous to equip fire safety doors with locks which automatically dead bolt the doors closed when fire strikes.

It is also important that an automatic fire safety lock does not operate accidentally to dead bolt a door which is in common use. If such an accident occurs, access through the door is cut off and a locksmith may have to be called to free the lock. Even more importantly, however, an automatic fire safety lock should only operate to dead bolt a safety door at a relatively high temperature. If this is not the case, people may be trapped in fire-tight compartments with little hope of escape while a fire intensifies.

SUMMARY OF THE INVENTION

In a preferred embodiment, to be described below in detail, the safety lock assembly of the present invention automatically dead bolts a closure, such as a fire safety door, to a closure frame, such as a fire safety door jamb, should a fire raise the ambient temperature above a predetermined temperature. Once dead bolted, this safety lock assembly is resistant to stresses resulting from warping of the safety door in intense heat generated in certain fires and from other causes which would tend to cause the lock assembly to fail. However, in normal operation, this safety lock assembly functions as does a ordinary door lock to permit easy access to rooms which form part of fire-tight compartments. Moreover, the safety lock assembly only functions to dead bolt the closure to the closure frame at a predetermined temperature which is above that at which human beings can survive. Therefore, occupants are provided with a means of escape through doors equipped with this lock assembly.

The safety lock assembly of the present invention comprises a striker plate which defines a bolt hole and is mounted on the closure frame. A cooperating latching mechanism, mounted in the closure, includes a housing and a bolt assembly mounted in the housing for reciprocal movement to and from a latched position projecting into the striker plate bolt hole. The bolt assembly is also mounted for further movement to an extreme dead bolted position projecting into the bolt hole beyond the latched position. A stop pin mechanism, associated with the bolt assembly, is operable to prevent the bolt assembly from being moved out of the dead bolted position once this position is assumed. A compressed coil spring urges the bolt toward this dead bolted position.

The bolt assembly is reciprocated to and from its latched position and ultimately to its dead bolted position by a bolt actuator mechanism which includes a crank and a substantially inextensible cable that connects the bolt assembly to the crank. A roller, which is disintegratable at the predetermined temperature, guides the cable through a first non-linear path having active length sufficient only to permit the bolt assembly to be reciprocated to its latched position. However, when the roller disintegrates at the predetermined temperature, the cable is permitted to traverse a second path which has active length sufficient to permit the bolt assembly to be reciprocated to its dead bolted position.

The stop pin mechanism includes an abutment plate mounted in the housing and having a guide hole therein. A stop pin is mounted with the bolt assembly and is engaged by the the abutment plate guide hole when the bolt assembly is not in its dead bolted position. However, when the bolt assembly is extended to this extreme dead bolted position, the stop pin disengages from the abutment plate guide hole and thereby wedges the bolt assembly in the dead bolted position to positively prevent movement therefrom.

Accordingly, it is an object of the present invention to provide a safety lock assembly which automatically dead bolts a closure, such as a fire safety door, to a closure frame, such as a safety door jamb, when the ambient temperature is raised above a high predetermined temperature by, for example, a fire.

Other objects, aspects, and advantages of the present invention will be pointed out in or will be understood from the following detailed description provided below in conjunction with the accompanying drawings.

DETAILED DESCRIPTION OF THE PREFERRED EMBODIMENT

Figures 1, 2:
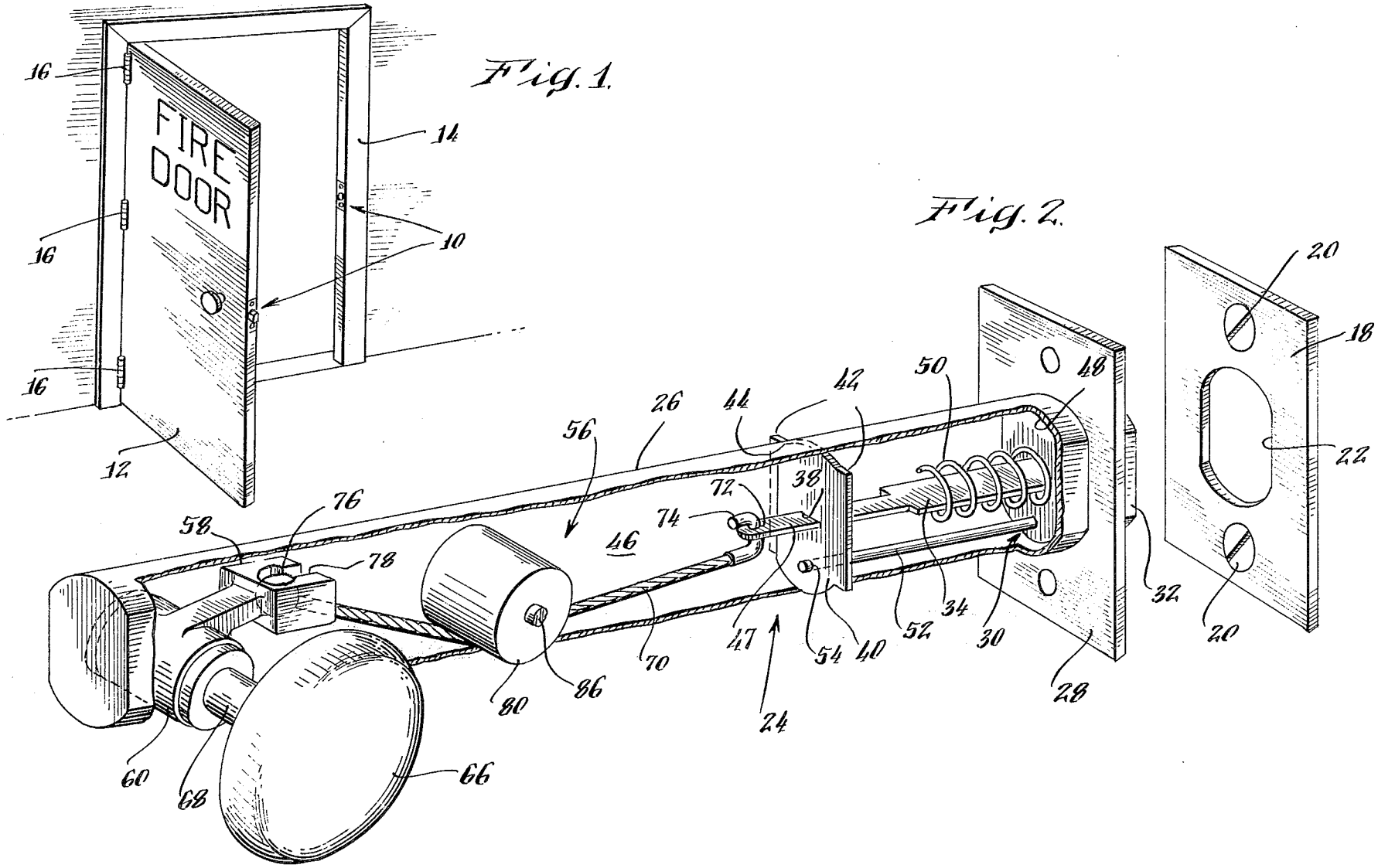
FIG. 1 is a perspective view of a fire safety door mounted to close into a fire safety door jamb and thus seal a fire-tight compartment. This door and jamb are equipped with the safety lock assembly of the present invention.
FIG. 2 is a perspective view of this safety lock assembly partly broken away to show internal detail.

Referring first to FIG. 1, the safety lock assembly 10 of the present invention is associated with a closure in the form of a fire safety door 12 and closure frame in the form of a fire safety door jamb 14. The door 12, which is mounted on a series of heavy-duty hinges 16 to pivotably close into jamb 14, seals a fire-tight compartment which may be a single room or a group of rooms in, for example, a commercial, industrial, or residential building. It is preferable that the door 12 and jamb 14 both be made of a fire-proof material such as heavy gauge steel so that they cooperate to effectively contain a fire. Further, it is desirable that the door be equipped with a suitable automatic closing device such as a hydraulic closing device (not shown) so that the door assumes a position normally closely into the jamb.

The safety lock assembly 10 functions to latch the door in its closed position to the door jamb during normal use and further functions, as will be described below in detail, to dead bolt the door to the jamb in the event that a fire raises the ambient temperature above a relatively high predetermined temperature.

As shown in FIG. 2, the safety lock assembly of the present invention includes a striker plate 18, which is mounted in door jamb 14 by any suitable means such as heavy duty bolts 20, and which further defines a bolt hole 22. A latching mechanism 24, which cooperates with striker plate 18 to latch the door in its closed position, is installed in the door 12 and includes an elongate housing 26, attached at one end to a front plate 28. A bolt assembly 30, mounted in housing 26 for reciprocal movement to and from a latched position (shown by solid lines in FIGS. 3 and 4), comprises a bolt head 32 which projects outwardly of front plate 28 when in this latched position and a bolt tail 34, which is attached to head 32 and extends backwardly into housing 26. Bolt head 32 is formed to project into bolt hole 22 of the striker plate 18 when the door 12 is closed into the jamb 14. Further, bolt head 32 has a conventional canted front face 36 (FIG. 4) which is adapted to engage striker plate 18 to cam the bolt assembly into housing 26 away from the latched position when the door is moved to its closed position.

The bolt tail 34 is registered in and guided by a hole 38 formed in an abutment plate 40 that is firmly mounted in housing 26 by ears 42 shaped and sized to project laterally out of complimentary slots 44 formed in the housing side walls 46. Further, a portion 47 of bolt tail 34 projects through hole 38. This engagement of the bolt tail 34 with abutment plate hole 38 and further engagement of bolt head 32 with a correspondingly sized hole 48 formed in front plate 28 cooperate to guide the bolt assembly 30 for its reciprocal movement in housing 26.

Figure 3:
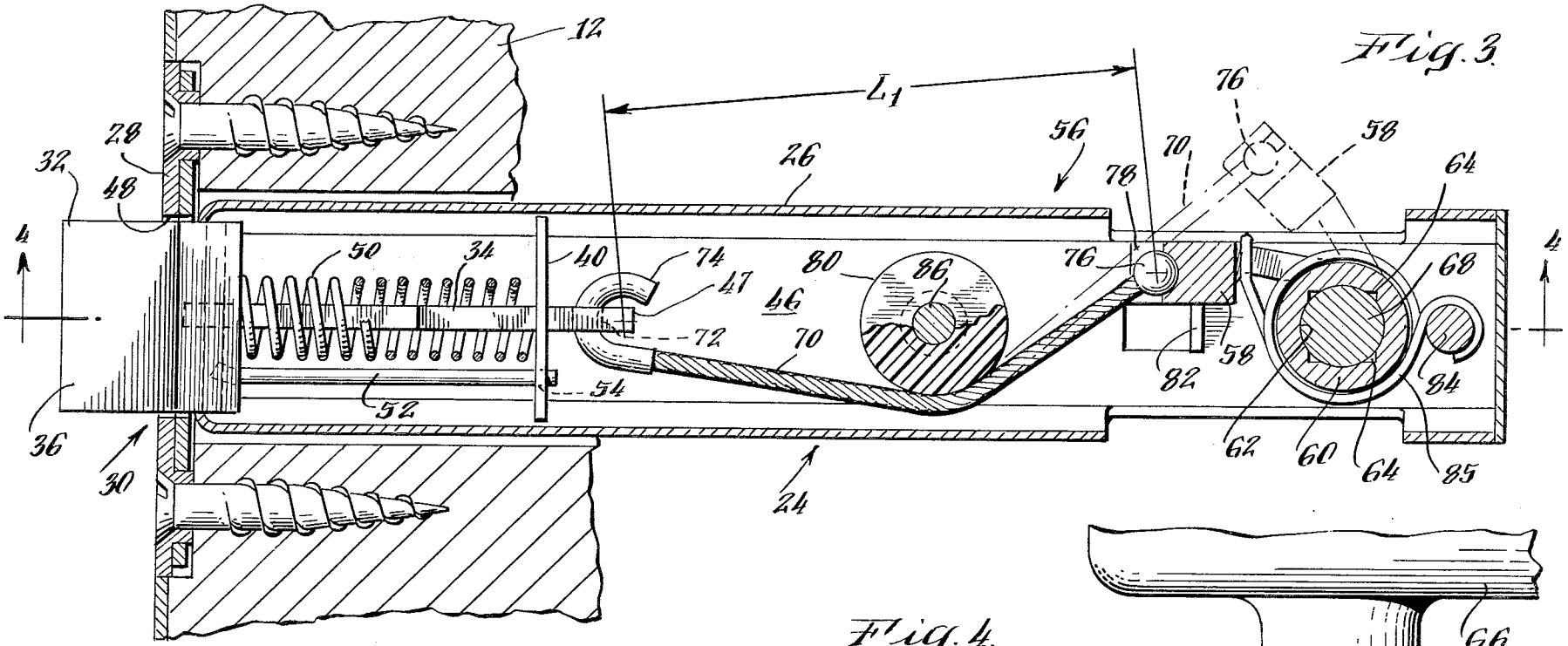
FIG. 3 is a vertical cross-sectional view of this safety lock assembly.
Figure 4:
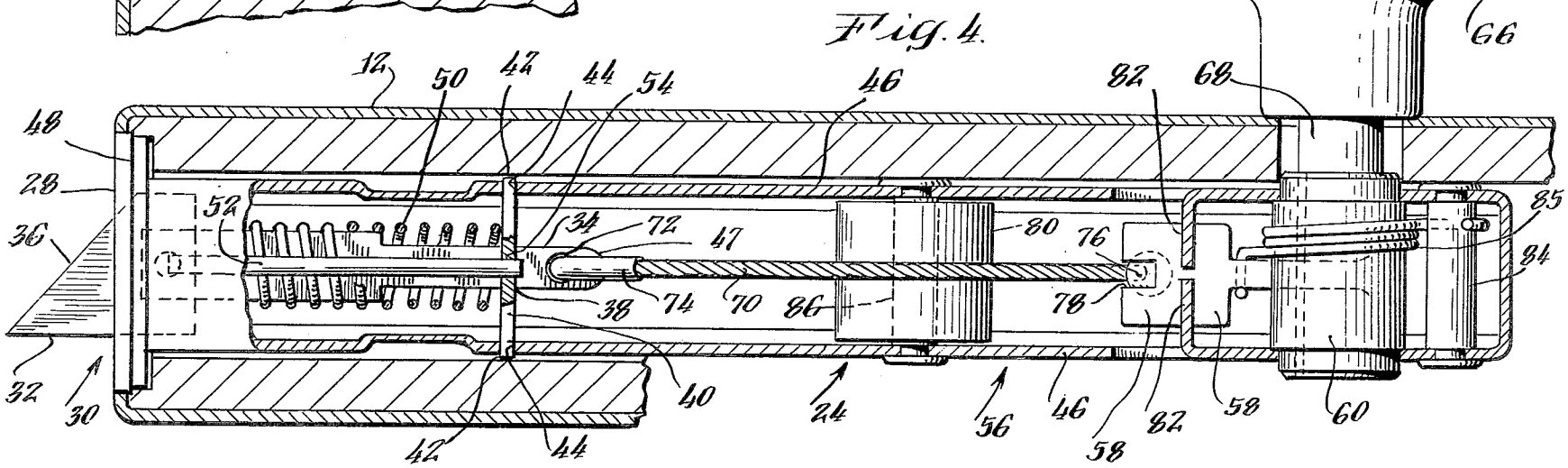
FIG. 4 is a horizontal cross-sectional view taken through plane 4—4 in FIG. 3 looking upward.
Figure 5:
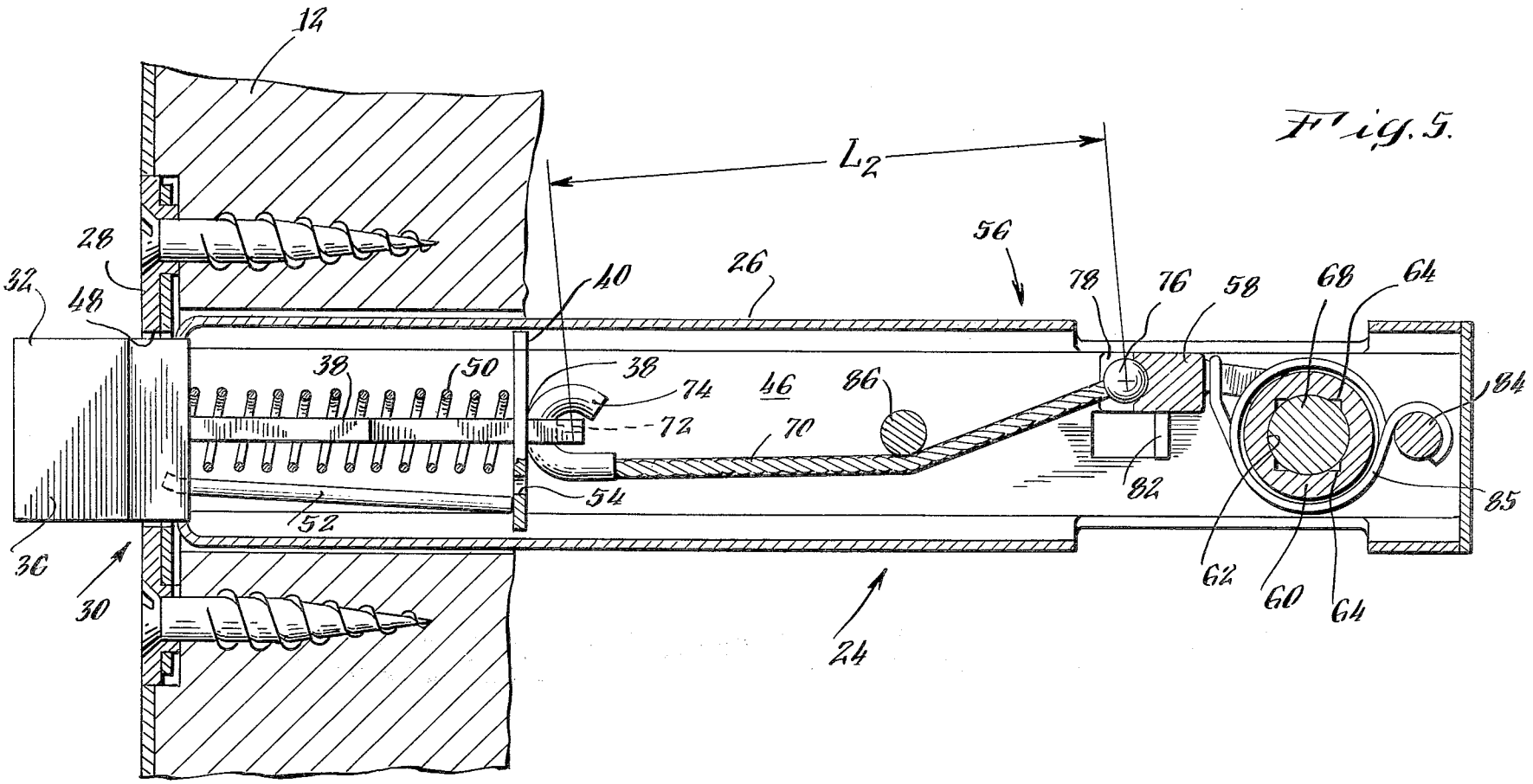
FIG. 5 is a vertical cross-sectional view similar to that shown in FIG. 3 but illustrating the lock assembly after the bolt assembly has been moved to its dead bolted position and held there by the stop pin mechanism.

A coil spring 50, broken away to show other details in FIG. 2 but having its full length in FIGS. 3, 4 and 5, is compressed between abutment plate 40 and the rear of bolt head 32 to urge the bolt assembly outwardly of housing 26 toward its latched position.

A stop pin mechanism, which operates to lock the bolt assembly 30 in a dead bolted position, includes a stop pin 52 that also is mounted in the rear face of bolt head 32 beneath bolt tail 34. Stop pin 52 is engaged by a second round hole 54 disposed through abutment plate 40 beneath the bolt tail guide hole 38.

Bolt assembly 30 is reciprocated by a bolt actuator mechanism, generally indicated at 56, which includes a Y-shaped crank 58 (see FIGS. 2 and 4) fixed to a pivotably mounted shaft 60 which laterally spans the interior of housing 26. Shaft 60 is provided with an axial bore 62 having a series of key slots 64 therein. A conventional doorknob 66 mounted on a drive shaft 68 is keyed by suitable key elements (not shown) to actuator shaft 60 so that rotation of the doorknob similarly rotates shaft 60 to pivot crank 58.

A cable 70 interconnects crank 58 and bolt assembly 30 in the following manner. Bolt tail 34 is provided with a hole 72 through the portion 47 which projects beyond abutment plate 40. A hook 74, which is firmly attached to cable 70, is engaged in hole 72 and serves as a swivel to provide a pivotable connection therewith. At its end opposite hook 74, cable 70 is provided with a generally spherical connector 76. The bifurcated end of Y-shaped crank 58 is formed to receive and thus engage the connector to complete the interconnection.

The cable 70 is guided between crank 58 and bolt tail 34 by a roller 80 which is disintegratable at the predetermined temperature but which serves as a solid guide at temperatures below the predetermined temperature. Accordingly, as shown in FIG. 3, when doorknob 66 is rotated in a clockwise direction, shaft 60 is similarly rotated, pivoting crank 58 to retract cable 70 about roller 80 through a first non-linear path and, hence, to retract bolt assembly 30 backwardly into housing 26 away from its latched position.

Moreover, prior to disintegration of roller 80, the bolt assembly 30 is prevented from traveling beyond its latched position since counterclockwise rotation of crank 58 is limited at a closed position by stops 82 which may be punched from the side walls 46 of housing 26. Crank 58 is urged to rotate in the clockwise direction, and thus move in a fashion complimentary to that urged by compressed coil spring 50, by a torsional spring 85 which grips crank 58 at one end and a fixed pin 84 laterally spanning the interior of the housing 26 at the other end. Thus, the bolt assembly 24 ordinarily operates in the same manner as does a conventional lock mechanism.

The automatic dead bolting feature of the present invention is provided by disintegratable roller 80, which is mounted on a solid steel shaft 86 that laterally spans the interior of housing 26. In particular, prior to disintegration, the roller 80 guides cable 70 through the first non-linear path having active length $L_1$ sufficient only to permit bolt head 32 to be urged outwardly of housing 26 to a latched position (FIG. 3) when counterclockwise rotation of crank 58 is limited by stops 82. However, after roller 80 disintegrates at the predetermined temperature, the cable 70 traverses a second path, now determined by steel shaft 86, which has sufficient active length $L_2$ to permit bolt head 32 to project outwardly of housing 26 beyond its latched position to a dead bolted position when counterclockwise rotation of crank 58 is limited by stops 82 (FIG. 5).

Accordingly, the bolt actuator mechanism comprising the crank 58, roller 80, and cable 70 moves the bolt between the latched and unlatched position and ultimately to the extreme dead bolted position.

Note that other disintegratable elements may be substituted for the roller 80 to increase the active length of the cable 70 at temperatures above the predetermined temperature. For example, a fixed disintegratable guide might be substituted for the roller, or an element associated with the cable may be made of disintegratable material, such as the hook 74 and spherical connector 76, to effectively lengthen the cable to permit the bolt assembly to extend to its extreme dead bolted position.

The stop pin mechanism operates to positively lock the bolt assembly in its dead bolted position once this position is assumed in the following manner. As shown in FIG. 3, throughout the reciprocal bolt assembly travel between latched and unlatched positions, stop pin 52 is positively engaged by the cooperating hole 54 in abutment plate 40 since cable 70 is guided by roller 80 over the first path having active length $L_1$. However, when the ambient temperature exceeds the predetermined temperature and roller 80 disintegrates, cable 70 traverses the second path having active length $L_2$ longer than normal operating active length $L_1$, thus permitting bolt assembly 30 to further extend to its dead bolted position. As shown in FIG. 5, stop pin 52 has length which causes it to disengage from hole 54 in abutment plate 40 when bolt mechanism 30 extends to this dead bolted position. Further, pin 52 is preferably press-fitted into the rear face of bolt head 32 in a manner that it springs downwardly out of registry with hole 54. This is, the stop pin 52 is press-fitted into bolt head 32 at an angle canted slightly downwardly and must be sprung upwardly for registry with hole 54 during assembly of the present invention. Accordingly, when bolt mechanism 30 extends to the dead bolted position, pin 52 wedges between abutment plate 40 and bolt head 32 and prevents retraction of the bolt assembly. In this way, the bolt actuator mechanism 56 is rendered inoperative to move bolt assembly 30 and the door 12 is positively dead bolted to jamb 14. Therefore, the door cannot be opened unless the lock assembly is broken.

The safety lock assembly of the present invention is simple in operation, has few moving parts, and is therefore extremely reliable. Moreover, it is easy and convenient to operate in normal use and can, therefore, be used as a lock mechanism for doors which are frequently opened and closed in the course of regular business. In its preferred embodiment, this lock assembly has dimensions compatible with standard lock dimensions. In particular, the lock housing 26 is mounted in a hole having diameter of 1 inch drilled 5 inches laterally into the door. The crank mechanism is exposed in a hole having diameter 2⅛ inches drilled through the side of the door and intersecting the 1 inch diameter hole. Moreover, the mechanical features of this lock assembly permit a design where the bolt has a ½ inch reciprocal travel and is retractible to its unlatched position with less than 45° rotation of the doorknob. When the nylon roller disintegrates, the bolt head projects an additional ⅛ inch beyond its latched position. This additional travel is sufficient for dimensioning of the stop pin 52 which provides positive engagement with the hole 54 and abutment plate 40 when the bolt is moved between latched and unlatched positions and positive disengagement of the pin 52 from hole 54 when the bolt is moved to its dead bolted position.

The roller 80 is preferably made of a disintegratable synthetic material such as nylon. Nylon disintegrates at approximately 600° F, a temperature well above that at which human life can survive but at which a fire can still be effectively confined to a fire-tight compartment to significantly limit further loss of life and property.

Although a specific embodiment of the present invention has been described above in detail, it is to be understood that this is for purposes of illustration. Other modifications may be made to the described structure by those skilled in the art in order to adapt this lock assembly for automatically dead bolting a closure to a closure frame to particular applications.

What is claimed is:

1. A lock assembly for automatically dead bolting a closure, such as a fire safety door, to a closure frame, such as a fire safety door jamb, in the event of fire raising the ambient temperature about a predetermined temperature, said lock assembly comprising:

A. striker plate means, for defining a bolt hole, mounted on one of said closure and closure frame;

B. a cooperating latching assembly mounted on the other of said closure and closure frame and including:

1. a housing,
2. a bolt assembly mounted on said housing for reciprocal movement to and from a latched position projecting into said bolt hole and for further movement to an extreme dead bolted position projecting into said bolt hole beyond the latched position,
3. stop means operable when said bolt assembly is moved to the dead bolted position to prevent movement of said bolt assembly out of said dead bolted position,
4. means for urging said bolt assembly toward the dead bolted position; and
5. bolt actuator means for moving said bolt assembly to and from its latched position and ultimately to its dead bolted position, said actuator means comprising,
   a. crank means,
   b. substantially inextensible cable means for interconnecting said crank means and said bolt assembly, and
   c. means, disintegratable at the predetermined temperature,
      1. for guiding said cable means through a first non-linear path of active length sufficient only to permit said bolt assembly to be reciprocated to its latched position; and
      2. for disintegrating at the predetermined temperature to permit said cable means to traverse a second path of active length sufficient to permit said bolt assembly to be reciprocated to the dead bolted position.

2. The lock assembly for automatically dead bolting a closure to a closure frame as claimed in claim 1 wherein said disintegratable means is a nylon roller.

3. The lock assembly for automatically dead bolting a closure to a closure frame as claimed in claim 1 wherein said crank means is a crank mounted in said housing for pivotable movement to and from a closed position corresponding to the latched position of said bolt assembly and wherein said bolt actuator means further comprises;

means for urging said crank to its closed position.

4. The lock assembly for automatically dead bolting a closure to a closure frame as claimed in claim 3 wherein said bolt actuator means further comprises:

means mounted in said housing to prevent movement of said crank beyond its closed position, thus preventing movement of said bolt assembly to the dead bolted position prior to disintegration of said roller means.

5. The lock assembly for automatically dead bolting a closure to a closure frame as claimed in claim 1 wherein said actuator means further comprises:
swivel means for connecting said cable means to said bolt assembly.

6. The lock assembly for automatically dead bolting a closure to a closure frame as claimed in claim 1 wherein stop means comprises:
A. an abutment plate mounted in said housing, one of said abutment plate and said bolt assembly having a guide hole,
B. stop pin means, mounted on the other of said abutment plate and said bolt assembly, to
1. be engaged in said guide hole when said bolt assembly is not in the dead bolted position, and
2. be disengaged from said guide hole when said bolt assembly is in the dead bolted position to wedge between said bolt assembly and said abutment plate and thereby prevent movement of said bolt assembly from the dead bolted position.

7. The lock assembly for automatically dead bolting a closure to a closure frame as claimed in claim 6 wherein said stop pin is mounted to be unregistered with said guide hole when disengaged therefrom.

8. A lock assembly comprising,
A. a housing
B. a bolt mounted for reciprocal movement within said housing,
C. spring means for urging said bolt into an extended latched position,
D. crank means for reciprocally moving said bolt,
E. a substantially inextensible, flexible cable interconnecting said crank means and said bolt,
F. a heat disintegratable means associated with said cable for effectively lengthening said cable to permit said spring means to further extend said bolt to a dead bolted position, and
G. stop means for positively maintaining said bolt in the dead bolted position once said bolt is so extended.

9. A lock assembly as claimed in claim 8 wherein said stop means comprises;
an abutment plate in said housing, said abutment plate having a guide hole therein, and
a stop pin on said bolt, said stop pin being reciprocally engaged in said guide hole when said heat disintegratable means is intact but disengaged from said guide hole when said heat disintegratable means is disintegrated to engage said abutment plate and lock said bolt in the dead bolted position.

10. A lock assembly as claimed in claim 8 wherein said heat disintegratable means is a roller over which said cable passes in a non-linear path in connecting said crank to said bolt, wherein disintegration of said roller by heat permits maximum extension of said bolt to the dead bolted position.

11. A lock assembly comprising:
A. a housing
B. a bolt assembly mounted in said housing for reciprocal movement to and from a latched position;
C. means for urging said bolt assembly toward the latched position;
D. bolt actuator means for moving said bolt assembly to and from its latched position comprising;
1. pivotable crank means for effecting bolt assembly movement, and
2. substantially inextensible cable means for interconnecting said crank means and said bolt assembly; said crank means, cable means and bolt assembly being arranged to fully move said bolt assembly away from its latched position with minimal pivoted movement of said crank means, and
E. heat disintegratable means associated with said cable means for effectively lengthening said cable means to permit said urging means to urge said bolt assembly to a dead bolted position extended beyond the latched position.

12. The lock assembly as claimed in claim 11 further comprising:
guide means for guiding said cable means from said bolt assembly to said crank means through a non-linear path.

13. The lock assembly as claimed in claim 11 further comprising:
stop means operable when said bolt assembly is moved to the dead bolted position to prevent movement of said bolt assembly out of the dead bolted position.

14. The lock assembly as claimed in claim 11 wherein said heat disintegratable means is a heat disintegratable roller which guides said cable means through a non-linear path.

15. The lock assembly as claimed in claim 13 wherein said stop means comprises:
A. an abutment plate mounted in said housing, one of said abutment plate and said bolt assembly having a guide hole;
B. stop pin means, mounted on the other of said abutment plate and said bolt assembly, to
1. be engaged in said guide hole when said bolt assembly is not in the dead bolted position, and
2. be disengaged from said guide hole when said bolt assembly is in the dead bolted position to wedge between said bolt assembly and said abutment plate and thereby prevent movement of said bolt assembly from the dead bolted position.

* * * * *